US009677423B2

(12) United States Patent
Faulder

(10) Patent No.: US 9,677,423 B2
(45) Date of Patent: Jun. 13, 2017

(54) COMPRESSOR AFT HUB SEALING SYSTEM

(71) Applicant: SOLAR TURBINES INCORPORATED, San Diego, CA (US)

(72) Inventor: Leslie John Faulder, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 414 days.

(21) Appl. No.: 14/311,127

(22) Filed: Jun. 20, 2014

(65) Prior Publication Data

US 2015/0369074 A1 Dec. 24, 2015

(51) Int. Cl.
*F01D 25/18* (2006.01)

(52) U.S. Cl.
CPC ..... *F01D 25/186* (2013.01); *F05D 2240/56* (2013.01)

(58) Field of Classification Search
CPC ..... F01D 25/12; F01D 25/125; F01D 25/16; F01D 25/162; F01D 25/183; F01D 25/186; F01D 11/02; F01D 11/04; F04D 29/08; F04D 29/083; F04D 29/10; F04D 29/102
See application file for complete search history.

(56) References Cited

U.S. PATENT DOCUMENTS

| | | | | |
|---|---|---|---|---|
| 4,497,172 | A | 2/1985 | Smith | |
| 4,544,167 | A | 10/1985 | Giroux | |
| 4,793,772 | A | 12/1988 | Zaehring et al. | |
| 5,522,698 | A | 6/1996 | Butler et al. | |
| 5,862,666 | A | 1/1999 | Liu | |
| 6,227,801 | B1 | 5/2001 | Liu | |
| 7,001,075 | B2 | 2/2006 | Bradshaw | |
| 7,287,384 | B2 | 10/2007 | Fish et al. | |
| 7,967,560 | B2 | 6/2011 | Dibenedetto | |
| 2004/0003968 | A1 | 1/2004 | Rakhmailov | |
| 2005/0235651 | A1 | 10/2005 | Morris et al. | |
| 2008/0080969 | A1 | 4/2008 | Legare et al. | |
| 2009/0107106 | A1 | 4/2009 | Munsell et al. | |
| 2012/0057967 | A1 | 3/2012 | Laurello et al. | |
| 2012/0156005 | A1 | 6/2012 | Nielsen et al. | |
| 2013/0291828 | A1 | 11/2013 | French | |
| 2014/0127007 | A1 | 5/2014 | Aiello et al. | |
| 2015/0139784 | A1* | 5/2015 | Grelin | F01D 9/065 415/116 |

FOREIGN PATENT DOCUMENTS

| | | | |
|---|---|---|---|
| GB | 2081819 | A | 2/1982 |

* cited by examiner

*Primary Examiner* — Dwayne J White
*Assistant Examiner* — Peter T Hrubiec
(74) *Attorney, Agent, or Firm* — Procopio, Cory, Hargreaves & Savitch LLP

(57) ABSTRACT

An aft hub sealing assembly for a gas turbine engine is disclosed. The aft hub sealing assembly includes an aft hub, a bearing cap, an aft baffle, a first seal, and a second seal. The aft hub includes a body portion and a disk portion aft surface. The bearing cap includes a bearing cap inner portion spaced apart from the body portion. The aft baffle is located adjacent the disk portion. The aft baffle includes a baffle forward surface following a contour of the disk portion aft surface. The first seal is between the bearing cap inner portion and the body portion. The second seal is between the bearing cap inner portion and the body portion.

20 Claims, 4 Drawing Sheets

COMPRESSOR AFT HUB SEALING SYSTEM

TECHNICAL FIELD

The present disclosure generally pertains to gas turbine engines, and is directed toward a gas turbine engine including a compressor aft hub sealing system.

BACKGROUND

Gas turbine engines include compressor, combustor, and turbine sections. Some of the air compressed in the compressor may be redirected along secondary paths within the gas turbine engine to cool various portions of the combustor and turbine sections. This redirected compressed air is heated during compression and may be further heated by windage heating as the compressed air travels along the secondary paths and drags on rotating components. Some of this heated compressed air may enter an oil sump and may lead to oil degradation and to a power loss of the gas turbine engine.

U.S. Pat. No. 4,544,167 to C. Giroux discloses a turbo-expander compressor for use in a gas processing system having a seal system that avoids communication of gas with the oil being pumped through the bearings. The device has a shaft carried in a housing on bearings with a compressor wheel on one side and an expander wheel on the other side. Labyrinth seals seal the wheels from the interior of the housing and the bearings. Mechanical seals are located between the bearings and the labyrinth seals for preventing leakage of oil. Gas is injected from the compressor discharge into a groove on the expander side of the shaft to provide a thermal barrier. The mechanical seals each have a rotating ring carried by the shaft and a nonrotating ring carried by the housing. The nonrotating ring is biased into the rotating ring by means of an O-ring. The O-ring is located in a groove in the bore and a recess formed in the nonrotating ring. The recess is offset to deform the ring and cause it to exert a force on the nonrotating ring against the rotating ring.

The present disclosure is directed toward overcoming one or more of the problems discovered by the inventors.

SUMMARY OF THE DISCLOSURE

An aft hub sealing assembly for a gas turbine engine is disclosed. In one embodiment, the aft hub sealing assembly includes an aft hub, a bearing cap, an air shield, an aft baffle, a first seal, a second seal, and a third seal. The aft hub includes a body portion, and a disk portion extending radially outward from the body portion. The disk portion includes a disk portion aft surface. The bearing cap includes a bearing cap body, a bearing cap outer flange extending from a first radially outer end of the bearing cap body, and a bearing cap inner portion located at a first radially inner end of the bearing cap body and spaced apart from the body portion. The air shield is axially forward of the bearing cap. The air shield includes an air shield body, an air shield outer flange extending from a second radially outer end of the air shield body and coupling to the bearing cap, and an air shield inner flange located at a second radially inner end of the air shield body and spaced apart from the body portion. The aft baffle is located between the air shield and the disk portion. The aft baffle includes a baffle forward surface facing the disk portion aft surface and a baffle forward surface generally following a contour of the disk portion aft surface. The first seal is between the bearing cap inner portion and the body portion. The second seal is between the bearing cap inner portion and the body portion. The third seal is between the air shield inner flange and the body portion.

DETAILED DESCRIPTION

The systems and methods disclosed herein include an aft hub sealing system. In embodiments, the aft hub sealing system includes an aft baffle adjacent the aft hub, a bearing cap including multiple seals, and an air shield including another seal. The combination of the aft baffle and seals may reduce the temperature and pressure within the bearing assembly supporting at least a portion of the aft hub by reducing/preventing windage heating and reducing/preventing the compressed gas from entering into the oil sump.

Figure 1:
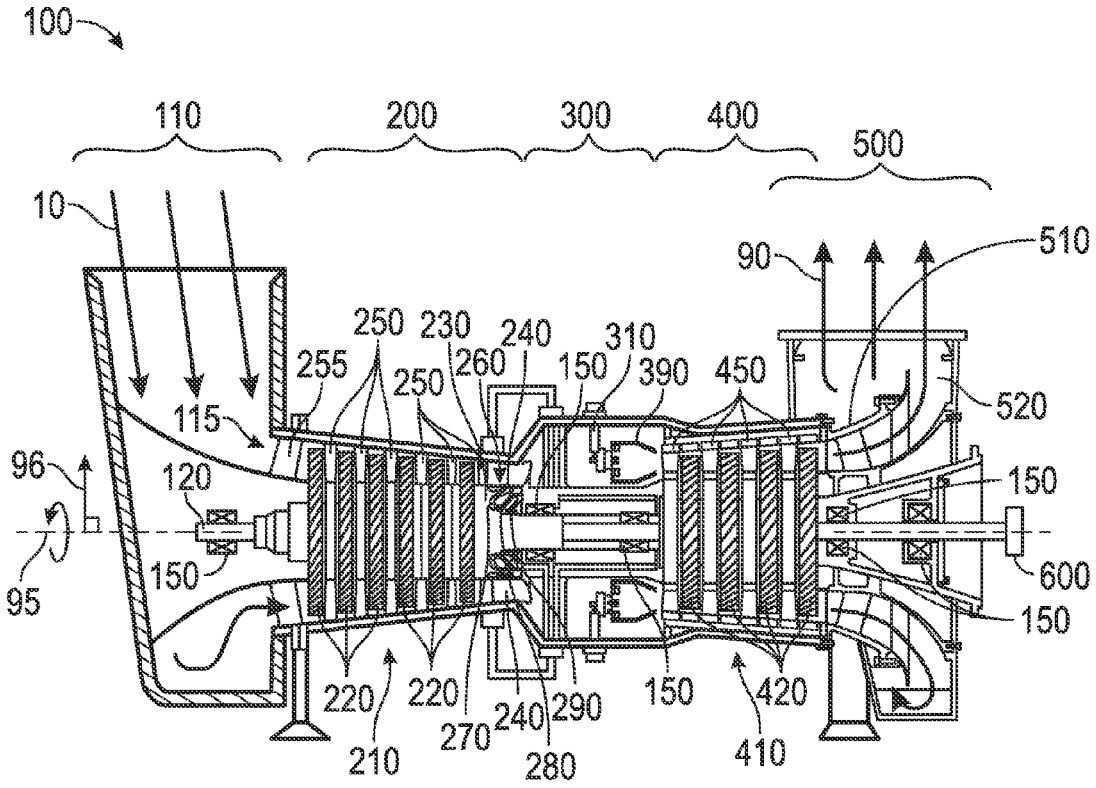
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from center axis 95, wherein a radial 96 may be in any direction perpendicular and radiating inward or outward from center axis 95.

A gas turbine engine 100 includes an inlet 110, a shaft 120, a gas producer or "compressor" 200, a combustor 300, a turbine 400, an exhaust 500, and a power output coupling 600. The gas turbine engine 100 may have a single shaft or a dual shaft configuration.

The compressor 200 includes a compressor rotor assembly 210, compressor stationary vanes ("stators") 250, inlet guide vanes 255, an aft hub 230 and an aft hub sealing assembly 260. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the first compressor stage.

The aft hub 230 may be located axially aft of the compressor disk assemblies 220 and may be coupled to the furthest aft compressor disk assembly 220. The aft hub sealing assembly 260 is configured to form a seal with the aft hub 230. The aft hub sealing assembly may include an aft baffle 270, an air shield 280, and a bearing cap 290.

The compressor 200 may also include a diffuser 240. The diffuser 240 may be located axially aft of the compressor disk assemblies 220 and may be located radially outward of at least a portion of the aft hub 230. Diffuser 240 may be configured to direct the compressed gas from the compressor 200 to the combustor 300.

The combustor 300 includes one or more injectors 310 and includes one or more combustion chambers 390.

The turbine 400 includes a turbine rotor assembly 410, and turbine nozzles 450 surrounded by a turbine housing. The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk that is circumferentially populated with turbine blades. A turbine nozzle 450 axially precedes each of the turbine disk assemblies 420. Each turbine disk assembly 420 paired with the adjacent turbine nozzle 450 that precedes the turbine disk assembly 420 is considered a turbine stage. Turbine 400 includes multiple turbine stages.

The exhaust 500 includes an exhaust diffuser 510 and an exhaust collector 520.

Figure 2:
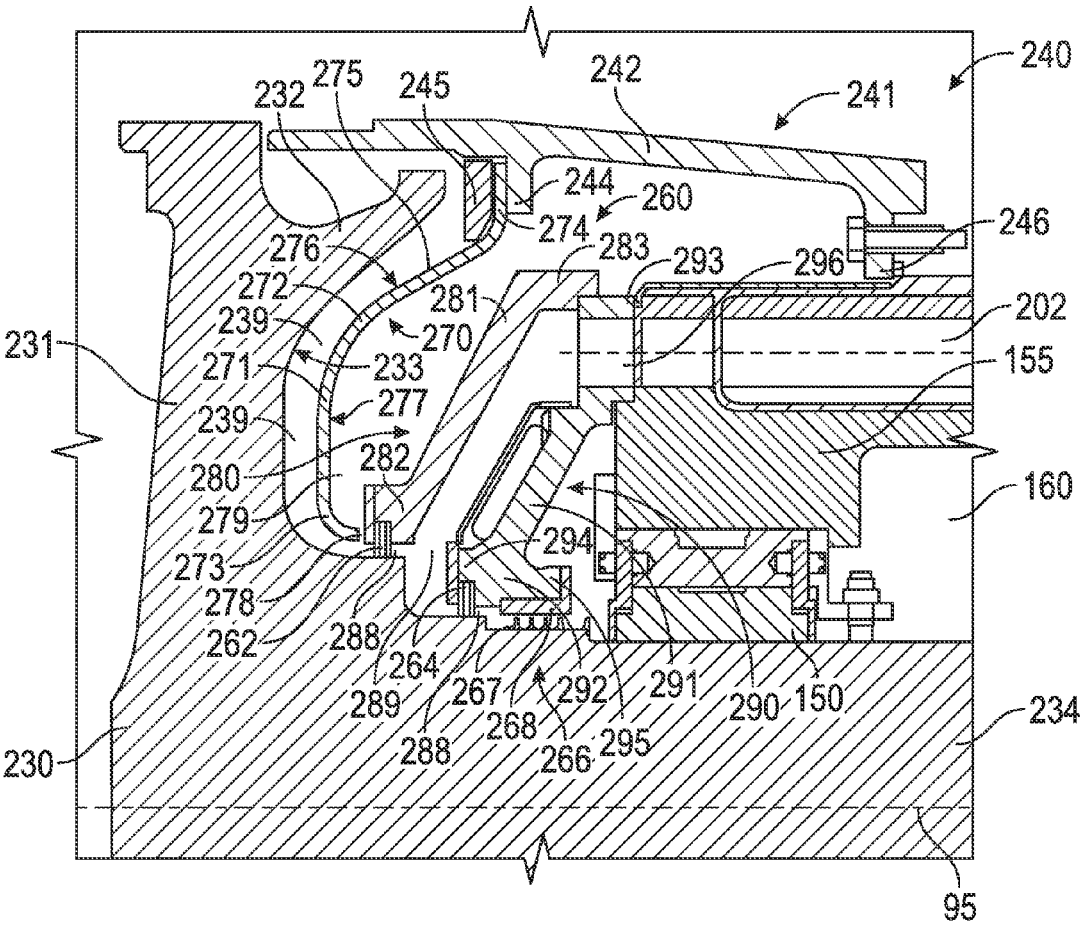
FIG. 2 is a section view of a portion of the compressor including the aft hub assembly of FIG. 1.

FIG. 2 is a section view of a portion of the compressor 200 including a portion of the aft hub 230 and the aft hub sealing assembly 260 of FIG. 1. Aft hub 230 may include a body portion 234 and a disk portion 231. Body portion 234 may generally be a cylindrical shape and may include a stepped cylinder configuration with the aft cylinders including smaller diameters than the adjacent forward cylinders. Disk portion 231 may extend radially outward from body portion 234. The outer edge of disk portion 231 may form a portion of the gas path leading into the diffuser. Disk portion 231 may include a disk protrusion 232 and a disk portion aft surface 233. Disk protrusion 232 may extend in both the axially aft and radially outward directions from the remainder of disk portion 231. Disk portion aft surface 233 is the aft surface of disk portion 231, facing in the aft direction.

Diffuser 240 may include an inner diffuser 241. Inner diffuser 241 may form the radially inner portion of diffuser 240. Inner diffuser 241 may include an inner diffuser body 242, a first inner diffuser flange 244, and a second inner diffuser flange 246. Inner diffuser body 242 may generally include a hollow cylinder shape. Inner diffuser body 242 may taper to increase or decrease the height between an outer diffuser and inner diffuser 241. The taper may be constant, or may increase/decrease over the length of inner diffuser body 242. First inner diffuser flange 244 may extend radially inward from inner diffuser body 242. First inner diffuser flange 244 may be an annular shape. Second inner diffuser flange 246 may be located aft of first inner diffuser flange 244 and may extend radially inward from inner diffuser body 242. Second inner diffuser flange 246 may also include a hollow cylinder shape. Second inner diffuser flange 246 may be adjacent the axial aft end of inner diffuser 241.

Aft hub sealing assembly 260 may be a stationary assembly that connects to other stationary components of the gas turbine engine 100, such as the inner diffuser 241 and a bearing assembly housing 155. Bearing assembly housing 155 may also support one or more bearing assemblies 150. In the embodiment illustrated, a bearing assembly 150 is located radially inward from bearing assembly housing 155 and is connected to bearing assembly housing 155. Bearing assembly 150 is configured to support aft hub 230 at body portion 234. Bearing assembly housing 155 and body portion 234 may form at least a portion of a oil sump 160. Bearing assembly housing 155 may include one or more cooling passages 202 extending in the axially aft direction.

Bearing cap 290 is located axially forward of bearing assembly housing 155 and radially outward of body portion 234. Bearing cap 290 includes a bearing cap body 291, a bearing cap outer flange 293, and a bearing cap inner portion 292. Bearing cap body 291 may include a frusto-conical shape. Bearing cap outer flange 293 may extend radially outward from bearing cap body 291 and may be located at the radially outer end of bearing cap body 291. Bearing cap outer flange 293 may include an annular shape and is configured to couple bearing cap 290 to bearing assembly housing 155, such as by bolting. One or more cooling holes 296 may extend axially through bearing cap outer flange 293 and may be in fluid communication with the one or more cooling passages 202.

Bearing cap inner portion 292 may include an inner portion forward end 294 and an inner portion aft end 295. Inner portion forward end 294 may extend axially forward from the radially inner end of bearing cap body 291, distal to bearing cap outer flange 293. Inner portion aft end 295 may extend axially aft from the radially inner end of bearing cap body 291 and may adjoin inner portion forward end 294. Inner portion forward end 294 and inner portion aft end 295 may each include a hollow cylinder shape. In the embodiment illustrated, inner portion forward end 294 is radially thicker than inner portion aft end 295.

Bearing cap inner portion 292 may be radially spaced apart from body portion 234 forming a radial gap 288 there between. A first seal 264 may be located at inner portion forward end 294 and a second seal 266 may be located at inner portion aft end 295 to prevent compressed air from entering into oil sump 160 by passing between bearing cap inner portion 292 and body portion 234. In the embodiment illustrated, first seal 264 is a brush seal extending radially inward from bearing cap inner portion 292 towards body portion 234, and second seal 266 is a labyrinth seal including teeth 267 formed on body portion 234 and a running surface 268 on bearing cap inner portion 292. Running surface 268 may be formed on or attached to inner bearing cap inner portion 292. In other embodiments, first seal 264 is the labyrinth seal and second seal 266 is the brush seal. In yet other embodiments, the labyrinth seal teeth are formed on bearing cap inner portion 292 and the running surface is on body portion 234.

Air shield 280 may be located axially forward of bearing cap 290 and radially outward of body portion 234. Air shield 280 includes an air shield body 281, an air shield outer flange 283, and an air shield inner flange 282. Air shield body 281 may include a frusto-conical shape. Air shield body 281 may be spaced apart from bearing cap body 291 forming a first air gap 289 there between. Cooling hole(s) 296 and cooling passage(s) 202 may extend in the axial aft direction from first air gap 289. Air shield outer flange 283 may be configured to couple air shield 280 to bearing cap 290, such as by press/interference fit or by bolting. Air shield outer flange 283 may extend axially aft from a radially outer end of air shield body 281 and may include a hollow cylinder shape.

Air shield inner flange 282 may be a hollow cylinder shape located at the radially inner end of air shield body 281 and may extend axially forward from air shield body 281. Air shield inner flange 282 may be spaced apart from body portion 234 forming a radial gap 288 there between. A third seal 262 may be located at air shield inner flange 282 to prevent compressed air from passing between air shield inner flange 282 and body portion 234 and into first air gap 289. Third seal 262 may be a brush seal extending radially inward from air shield inner flange 282 towards body portion 234. As illustrated in FIG. 2, each seal may be located at a different tier of the stepped cylinder configuration of the body portion 234.

Aft baffle 270 may generally be located between disk portion 231 and air shield 280. Aft baffle 270 may be spaced apart from disk portion 231 forming a second air gap 239 there between. Aft baffle 270 may also be spaced apart from air shield 280 forming a third air gap 279 there between. The contour of aft baffle 270 may follow the general contour of disk portion aft surface 233.

Aft baffle 270 may include a baffle radial portion 271, a baffle curved portion 272, a baffle outer portion 275, a baffle flange 274, and a baffle inner portion 273. Baffle radial portion 271 may be a flat form and may generally extend in a radial direction. Baffle curved portion 272 may curve aft from the radial outer end of baffle radial portion 271 and may have a constant radius and may transition between baffle radial portion 271 and baffle outer portion 275. Baffle outer portion 275 may extend radially outward and axially aft from baffle curved portion 272. Baffle outer portion 275 may include a frusto-conical shape.

Baffle flange 274 may extend radially outward from a radially outer end of baffle outer portion 275. The connection between baffle flange 274 and baffle outer portion 275 may be rounded. Baffle flange 274 may generally include a radial shape and may be configured to couple to first inner diffuser flange 244, such as by bolting.

Baffle inner portion 273 may extend from the radially inner end of baffle radial portion 271. Baffle inner portion 273 may curve from the radially inward direction to the axially aft direction extending towards air shield inner flange 282. Baffle inner portion 273 may be spaced apart from air shield inner flange 282 forming an axial gap 278 there between.

Aft baffle 270 may also include a baffle forward surface 276 and a baffle aft surface 277. Baffle forward surface 276 may face disk portion aft surface 233. Baffle forward surface 276 may include a contour similar to that of disk portion aft surface 233. Baffle forward surface 276 and disk portion aft surface 233 may respectively form the aft and forward boundary of second air gap 239. Baffle aft surface 277 may be opposite baffle forward surface 276.

Clamp ring 245 may be an annular body configured to couple to first inner diffuser flange 244 and clamp baffle flange 274 there between.

Figure 3:
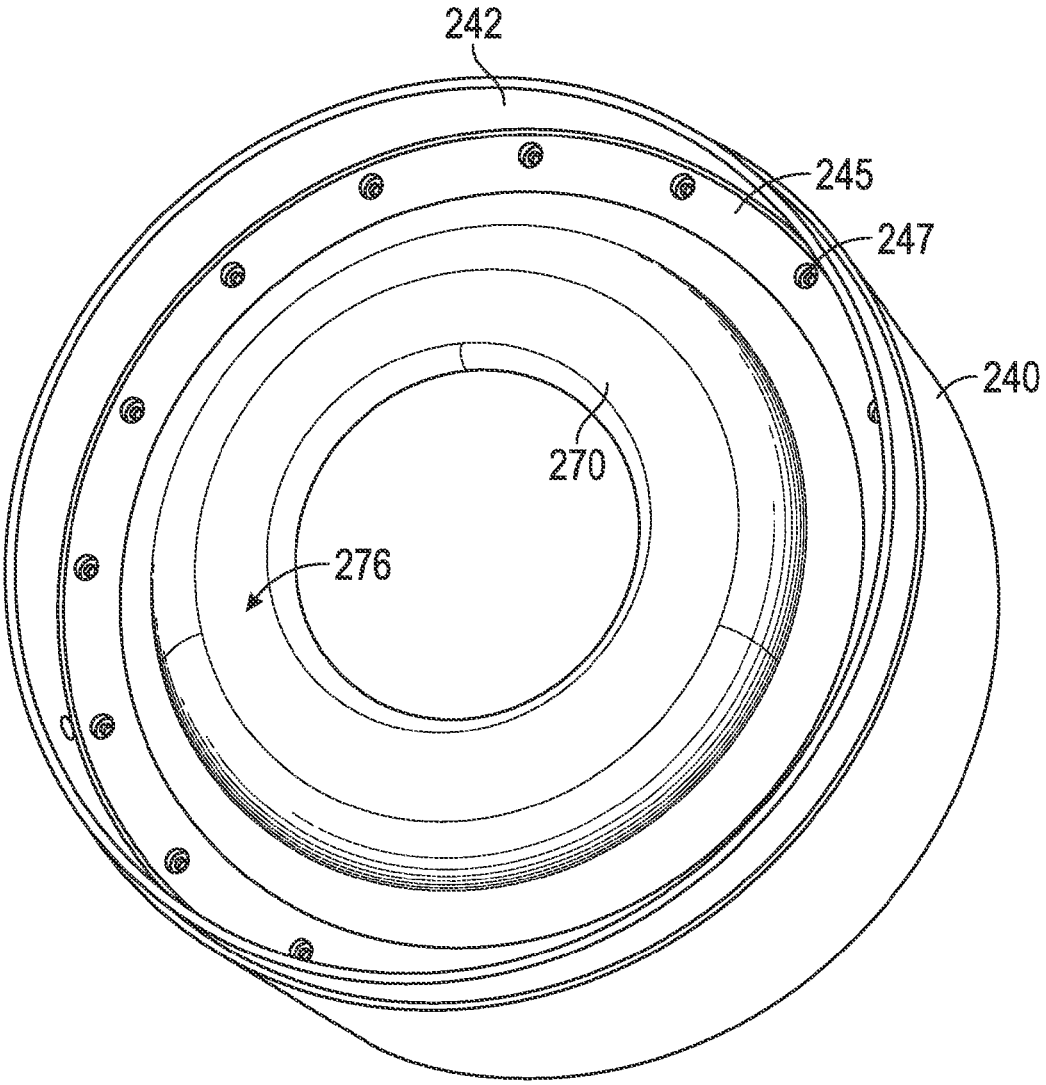
FIG. 3 is a perspective view of the aft baffle of FIG. 2 clamped to the inner diffuser.
Figure 4:
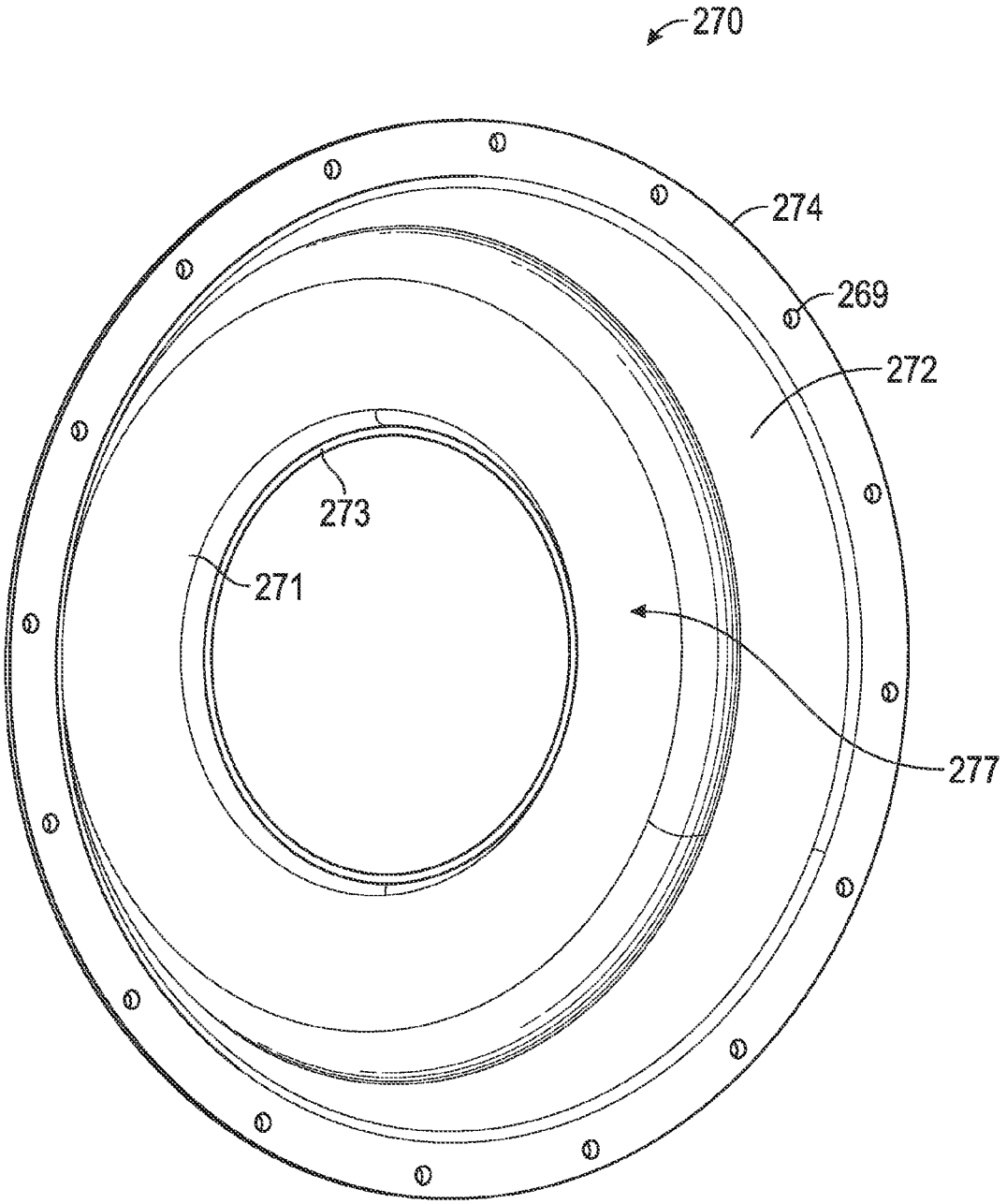
FIG. 4 is a perspective view of the aft baffle of FIG. 3.

FIG. 3 is a perspective view of the aft baffle 270 of FIG. 2 clamped to the inner diffuser 241. FIG. 4 is a perspective view of the aft baffle 270 of FIG. 3. As illustrated in FIGS. 3 and 4, baffle flange 274 may include baffle bolt holes 269 and clamp ring 245 may include clamp ring bolt holes 247 that are configured to receive bolts for clamping baffle flange 274 between clamp ring 245 and first inner diffuser flange 244.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with the 4th compressor disk assembly 220 in the downstream or "aft" direction, going from the inlet 110 towards the exhaust 500). Likewise, each turbine disk assembly 420 may be associated with a numbered stage.

Once compressed air 10 leaves the compressor 200, it enters the combustor 300, where it is diffused and fuel is added. Air 10 and fuel are injected into the combustion chamber 390 via injector 310 and combusted. Energy is extracted from the combustion reaction via the turbine 400 by each stage of the series of turbine disk assemblies 420. Exhaust gas 90 may then be diffused in exhaust diffuser 510, collected and redirected. Exhaust gas 90 exits the system via an exhaust collector 520 and may be further processed (e.g., to reduce harmful emissions, and/or to recover heat from the exhaust gas 90).

A portion of the compressed gas may be directed into cooling paths, such as cooling passage 202, and to various portions of the combustor 300 and the turbine 400 to cool various components such as the combustion chamber 390 and the turbine nozzles 450. Some of this compressed gas may flow axially aft of the aft hub 230 and may be heated by windage heating. Providing an aft baffle 270 adjacent the aft hub 230 may reduce the windage heating of the compressed gas flowing axially aft of the aft hub 230. Reducing the windage heating may reduce the parasitic power loss caused by this heating and may increase the effectiveness of the compressed gas as a cooling medium, as well as reducing the temperature of the various components and materials that contact the compressed gas.

While this compressed gas may function as a cooling medium within the combustor 300 and the turbine 400, this compressed gas may increase both the pressure and the temperature within the oil sump 160, which may lead to oil contamination and degradation, and may also lead to degradation of the various seals used within the oil circulation system.

Providing a bearing cap 290 with a first seal 264 and a second seal 266 along with aft baffle 270 may reduce/prevent the compressed gas from entering the oil sump 160, and may prevent the increases in pressure and temperature within the sump. The first seal 264 and the second seal 266 may be a brush seal and a labyrinth seal paired together. Brush seals may be more tolerant to vibration and movement/imbalance, while a labyrinth seal is generally more durable.

Third seal 262 may be as tight as possible with the distance between the third seal 262 and the aft hub body portion 234 being as small as possible. Third seal 262 may reduce the amount and pressure of the compressed gas entering into first air gap 289 and may reduce the heat load on the bearing cap 290 and may further reduce the pressure/temperature increase within the oil sump 160. In embodiments, the gas turbine engine 100 may be reconfigured to direct the compressed gas into the cooling passage(s) 202 from a different portion of the gas turbine engine 100.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes a particular aft hub sealing assembly, it will be appreciated that the aft hub sealing assembly including the aft baffle in accordance with this disclosure can be implemented in various other configurations, can be used with various other types of gas turbine engines, and can be used in other types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. An aft hub sealing assembly for a gas turbine engine, the aft hub sealing assembly comprising:

an aft hub including a body portion, and a disk portion extending radially outward from the body portion, the disk portion including a disk portion aft surface;

a bearing assembly housing;

a bearing assembly located radially inward from the bearing assembly housing and connected to the bearing assembly housing, the bearing assembly supporting the aft hub at the body portion;

a bearing cap axially forward of the bearing assembly housing, the bearing cap including a bearing cap body, a bearing cap outer flange extending from a first radially outer end of the bearing cap body, the bearing cap outer flange coupling to the bearing assembly housing, and a bearing cap inner portion located at a first radially inner end of the bearing cap body and spaced apart from the body portion and extending axially forward of the first radially outer end;

an air shield axially forward of the bearing cap, the air shield including an air shield body, an air shield outer flange extending from a second radially outer end of the air shield body and coupling to the bearing cap, and an air shield inner flange located at a second radially inner end of the air shield body and spaced apart from the body portion;

an aft baffle located between the air shield and the disk portion, the aft baffle including a baffle forward surface facing the disk portion aft surface, the baffle forward surface generally following a contour of the disk portion aft surface and configured to reduce windage heating of compressed gas flowing axially aft of the aft hub;

a first seal disposed between the bearing cap inner portion forward end and the body portion;

a second seal disposed between the bearing cap inner portion aft end and the body portion; and a third seal disposed between the air shield inner flange and the body portion.

2. The aft hub sealing assembly of claim 1, further comprising:

an inner diffuser including an inner diffuser body located radially outward of the bearing assembly housing, the bearing cap, the air shield, and the aft baffle, and a first inner diffuser flange extending radially inward from the inner diffuser body, wherein the aft baffle includes a baffle flange coupled to the inner diffuser flange.

3. The aft hub sealing assembly of claim 2, further comprising a clamp ring with an annular shape, wherein the baffle flange is clamped between the inner diffuser flange and the clamp ring.

4. The aft hub sealing assembly of claim 1, wherein the first seal is a brush seal extending radially inward from the bearing cap inner portion and the second seal is a labyrinth seal.

5. The aft hub sealing assembly of claim 4, wherein the second seal includes teeth extending from the aft hub and a running surface on the bearing cap inner portion.

6. The aft hub sealing assembly of claim 4, wherein the third seal is a brush seal extending radially inward from the air shield inner flange towards the body portion.

7. A gas turbine engine including the aft hub sealing assembly of claim 1.

8. An aft hub sealing assembly for a gas turbine engine, the aft hub sealing assembly comprising:

an aft hub including a body portion, and a disk portion extending radially outward from the body portion, the disk portion including a disk portion aft surface;

a bearing cap including a bearing cap body, a bearing cap outer flange extending from a first radially outer end of the bearing cap body, and a bearing cap inner portion located at a first radially inner end of the bearing cap body and spaced apart from the body portion and extending axially forward of the first radially outer end, the bearing cap inner portion including an inner portion forward end extending axially forward from the bearing cap body, and an inner portion aft end extending axially aft from the bearing cap body;

an aft baffle located adjacent the disk portion, the aft baffle including a baffle forward surface facing the disk portion aft surface and spaced apart from the disk portion aft surface forming an air gap there between the aft baffle being configured to reduce windage heating of compressed gas flowing axially aft of the aft hub;

a first seal between the inner portion forward end and the body portion, the first seal being a brush seal extending radially inward from the inner portion forward end toward the body portion; and a second seal between the inner portion aft end and the body portion, the second seal being a labyrinth seal.

9. The aft hub sealing assembly of claim 8, wherein the second seal includes teeth extending from the aft hub and a running surface on the bearing cap inner portion.

10. The aft hub sealing assembly of claim 8, wherein the aft baffle includes:

a baffle radial portion generally extending in a radial direction;

a baffle curved portion curving aft from a second radially outer end of the baffle radial portion;

a baffle outer portion extending radially outward and axially aft from the baffle curved portion, the baffle outer portion including a frusto-conical shape;

a baffle flange extending radially outward from the baffle outer portion; and a baffle inner portion extending from a second radially inner end of the baffle radial portion, the baffle inner portion curving from a radially inward direction to a axially aft direction.

11. The aft hub sealing assembly of claim 10, further comprising an inner diffuser including an inner diffuser body located radially outward from the bearing cap and the aft baffle, and a first inner diffuser flange extending radially inward from the inner diffuser body, wherein the baffle flange is coupled to the first inner diffuser flange.

12. The aft hub sealing assembly of claim 11, further comprising a clamp ring with an annular shape, wherein the baffle flange is clamped between the inner diffuser flange and the clamp ring.

13. The aft hub sealing assembly of claim 10, further comprising:

an air shield located axially forward of the bearing cap, the air shield including an air shield body, an air shield outer flange extending from the air shield body and coupling to the bearing cap outer flange, and an air shield inner flange spaced apart from the body portion, wherein the baffle inner portion extends in the axially aft direction towards the air shield inner flange; and a third seal between the air shield inner flange and the body portion, the third seal being a brush seal extending radially inward from the air shield inner flange towards the body portion.

14. The aft hub sealing assembly of claim 10, further comprising:

a bearing assembly housing, wherein the bearing cap outer flange is coupled to the bearing assembly housing; and a bearing assembly located radially inward from the bearing assembly housing and connected to the bearing assembly housing, the bearing assembly supporting the aft hub at the body portion.

15. An aft hub sealing assembly for a gas turbine engine, the aft hub sealing assembly comprising:

an aft hub including a body portion, and a disk portion extending radially outward from the body portion;

a bearing cap including a bearing cap body including a first frusto-conical shape, a bearing cap outer flange extending from a first radially outer end of the bearing cap body, and a bearing cap inner portion located at a first radially inner end of the bearing cap body and spaced apart from the body portion;

an air shield axially forward of the bearing cap, the air shield including an air shield body including a second frusto-conical shape, an air shield outer flange extending from a second radially outer end of the air shield body and coupling to the bearing cap, and an air shield inner flange located at a second radially inner end of the air shield body and spaced apart from the body portion;

an inner diffuser including an inner diffuser body located radially outward of the bearing cap and the air shield, and a first inner diffuser flange extending radially inward from the inner diffuser body;

an aft baffle located between the air shield and the disk portion and configured to reduce windage heating of compressed gas flowing axially aft of the aft hub, the aft baffle including a baffle radial portion extending generally in a radial direction;

a baffle curved portion curving aft from a second radially outer end of the baffle radial portion, a baffle outer portion extending radially outward and axially aft from the baffle curved portion, the baffle outer portion including a third frusto-conical shape, a baffle flange extending radially outward from the baffle outer portion, the baffle flange being coupled to the first inner diffuser flange, and a baffle inner portion extending from a second radially inner end of the baffle radial portion, the baffle inner portion curving from a radially inward direction to an axially aft direction;

a first seal between the bearing cap inner portion and the body portion, the first seal being a brush seal;

a second seal between the bearing cap inner portion and the body portion, the second seal being a labyrinth seal; and a third seal between the air shield inner flange and the body portion, the third seal being a second brush seal.

16. The aft hub sealing assembly of claim 15, further comprising a clamp ring with an annular shape, wherein the baffle flange is clamped between the inner diffuser flange and the clamp ring.

17. The aft hub sealing assembly of claim 15, further comprising a bearing assembly housing, wherein the bearing cap outer flange is coupled to the bearing assembly housing, and wherein the bearing assembly housing and the body portion form at least a portion of an oil sump.

18. The aft hub sealing assembly of claim 17, a bearing assembly located radially inward and supported by the bearing assembly housing.

19. The aft hub sealing assembly of claim 15, wherein the disk portion includes a disk portion aft surface, and wherein the aft baffle includes a baffle forward surface facing the disk portion aft surface and spaced apart from the disk portion aft surface forming an air gap there between.

20. The aft hub sealing assembly of claim 15, wherein the disk portion includes a disk protrusion extending in both the axially aft and the radially outward directions towards the inner diffuser.

* * * * *